United States Patent [19]

Stenudd

[11] Patent Number: 4,877,342

[45] Date of Patent: Oct. 31, 1989

[54] METHOD OF MOVING PRINT ELEMENTS IN PRINTHEADS AND A PRINTHEAD WITH MOVING MECHANISM FOR PRINT ELEMENTS

[75] Inventor: Sven G. V. Stenudd, Lidingö, Sweden

[73] Assignee: Facit Aktiebolag, Sundbyberg, Sweden

[21] Appl. No.: 165,732

[22] Filed: Mar. 9, 1988

[30] Foreign Application Priority Data

Mar. 27, 1987 [SE] Sweden ..... 8701287

[51] Int. Cl.[4] ..... B41J 3/12; B41J 9/38

[52] U.S. Cl. ..... 400/121; 101/93.05; 101/93.03; 400/157.3; 400/166; 400/124

[58] Field of Search ..... 400/121, 124, 157.2, 400/157.3, 166; 101/93.05, 93.03; 335/256, 266, 267

[56] References Cited

U.S. PATENT DOCUMENTS

| | | | |
|---|---|---|---|
| 3,946,851 | 3/1976 | Cestrieres | 400/124 |
| 4,046,244 | 9/1977 | Velazquez | 400/124 |
| 4,072,224 | 2/1978 | Barnaby | 400/124 |
| 4,396,304 | 8/1983 | Davenport | 400/157.2 |
| 4,472,072 | 9/1984 | Harada | 400/124 |
| 4,498,791 | 2/1985 | Gilbert | 400/124 |
| 4,584,937 | 4/1986 | Bringhurst | 101/93.48 X |

FOREIGN PATENT DOCUMENTS

| | | | |
|---|---|---|---|
| 36469 | 3/1983 | Japan | 400/124 |
| 49852 | 3/1986 | Japan | 400/124 |

OTHER PUBLICATIONS

IBM Tech. Disc. Bulletin, vol. 28, No. 12, May 1986, pp. 5296–5298, "High Performance, One-Piece Print Actuator".

*University Physics*, 3rd Edition, by F. W. Sears & M. W. Zemansky, Addison-Wesley, 1964, pp. 741–750.

*Primary Examiner*—Paul T. Sewell

*Attorney, Agent, or Firm*—Burns, Doane, Swecker & Mathis

[57] ABSTRACT

The invention relates to a method in printheads (1) with a plurality of print elements (4) arranged movable in relation to each other and a moving mechanism (7, 9, 11, 12, 14) with magnetic field-responsive forces for moving selectable print elements to print or inactive positions. With utilization of the method the forces with which selected print elements are moved in appropriate cases to their print positions can be changed in coordination for a plurality of print elements. In accordance with the invention this is achieved by a magnetic field change coordinated for several print elements. The invention also relates to a printhead (1) with a plurality of first electromagnet means (9, L1 L24) for moving selectable print elements (4) and also a second electromagnet means (LB) common to a plurality of print elements, for coordinated change of the forces for a plurality of print elements with which the print elements can be moved to their print positions. A method and a printhead in accordance with the invention are primarily intended for matrix printers.

14 Claims, 3 Drawing Sheets

METHOD OF MOVING PRINT ELEMENTS IN PRINTHEADS AND A PRINTHEAD WITH MOVING MECHANISM FOR PRINT ELEMENTS

TECHNICAL FIELD

The present invention relates to a method in printheads with a plurality of print elements arranged movable in relation to each other, the printhead having a moving mechanism with magnetic field-responsive forces for moving selectable print elements to print and inactive positions. The invention also relates to such a printhead.

More particularly, the invention relates to a method and means in printheads of the kind given above for coactively changing the forces with which the moving mechanism moves the print elements to their positions.

BACKGROUND ART

In printheads with a plurality of print elements arranged movable in relation to each other it is already known to have a moving mechanism with magnetic field-responsive forces for moving selectable print elements to print and rest positions. In such cases it is also known to have in the moving mechanism a plurality of electromagnetic means with changeable current for achieving magnetic field changes, and thereby changes in the magnetic field-responsive forces. Such printheads are known from such as U.S. Pat. Nos. 4,233,894, 4,393,771, 4,438,692, 4,503,758 and 4,509,421.

Mechanical springs, permanent magnets and electromagnets are used in moving mechanisms in printheads of the kind given above for moving the print elements individually and in groups to print and inactive positions. For example, the U.S. Pat. No. 4,584,937 teaches the use of a common permanent magnet for several print elements, with individual electromagnetic cores of ferromagnetic material and to have individual electromagnetic windings for each print element. Here, the permanent magnet is adapted such that it is included in a magnetic circuit for each of the print element. A mechanism spring is associated with each print element, and adapted such that its spring bias strives to move the element towards a given print position when the element is in a given inactive position. However, in the absence of current in one electromagnet means the magnet fieldresponsive forces originating from the permanent magnet in the magnet circuit are sufficiently strong to overcome the spring bias, and to keep the print element in its inactive position. For selectively moving print elements individually or in groups to their print positions, a current of suitable size and direction is supplied to an electromagnet winding in the electromagnet means which is/are associated with the selectable print element(s) which is/are to be moved. The respective current then weakens the magnetic field in the magnetic circuit in the respective print element so that the magnetic field-responsive forces become weaker than the mechanical spring forces, and the respective print element can be moved to its print position by the spring bias.

DISCLOSURE OF INVENTION

In printing with printheads, which have a plurality of print elements arranged movable in relation to each other and a moving mechanism for moving the elements between print and inactive positions, there is a need of changing in co-ordination, for all or a plurality of print elements, the forces with which the moving mechanism moves the print elements to their print positions in the cases in question. Such a need can occur, e.g. in changing the type of record carrier on which printing takes place, or when it is desired to print both original and copies with the aid of intermediate carbon paper. Different types of carriers and simultaneous printing of different numbers of copies may require that the print elements in their print positions strike the record carriers at different speeds or force or impact energy. If the mass of the print elements is not changed, then the forces in the moving mechanism must be changed. There may also be other reasons for changing the forces on the print elements in their movement to their respective positions In known printheads, which have moving mechanisms including mechanical springs, permanent magnets and individual electromagnet means for the print elements, the velocity of the individual print elements can in some cases be varied to a certain extent in moving to the print position, by varying the size of the current supplied to the electromagnet means of the respective print element during the printing operation. A problem is, however, that such variation of a current to an electromagnet means only varies the speed or impact energy of the print element in question. If the speed or impact energy of all or several print elements is desired to be varied in co-ordination, e.g. on exchanging record carriers or the number of simultaneously printed copies, the currents to all or several electromagnetic means must be varied in coordination. This is of course possible with modern control technique but is not particularly simple or cheap.

One object of the present invention is to provide a method and means in connection with printheads as of the kind mentioned in the introduction, whereby the forces of the moving mechanism and the speed or impact energy of the print element in moving to the print position can be changed simply and cheaply in co-ordination. It is also an object to provide a printhead with the facility of changing these forces, and which is simple and cheap to manufacture. A further object of the present invention is to provide a printhead which is comparatively small and has a robust structure, in spite of having many print elements and the facility of changing their speed.

In a method and a printhead in accordance with the invention, the variations of the moving mechanism forces or impact energy in the movement of the prnt element to its respective positions are provided in appropriate cases with the aid of an electromagnet means common to a plurality of print elements. By changing a current in this common electromagnet means there is achieved a substantial common, magnetic field change covering a plurality of print elements in the printhead. The magnetic field-responsive forces are thus changed in co-ordination, in the moving mechanism these forces essentially affecting the position and possible movement of a plurality of print elements. Further to this common electromagnet means, the printhead has a plurality of electromagnet means adapted for achieving movement of selectable print elements individually and in groups. By different combinations of changes in current in these electromagnetic means, different magnetic field changes with different coverages corresponding to selectable print element movements can be achieved. The actual change in the magnetic field is not desirable in itself; what is desirable are the differences before and after the change between the respective magnetic fields and forces.

In a method in accordance with the invention, magnetic field changes for movement of individual print elements as well as for variation of the movement speed is preferably achieved in appropriate cases by direct induction in the ferromagnetic portions of magnetic circuits unique to the respective print element. In a printhead in accordance with the invention, a plurality of electromagnet means each includes its own core portion and its own electromagnet winding on its core portion, and the common electromagnet means includes an electromagnet winding extending about a plurality of core portions.

A printhead in accordance with the invention preferably includes a plurality of electromagnet means, each with its individual core portion, the common electromagnetic means including a winding extending round all the individual core portions of the printhead. Here, it is particularly preferable for the elongate portions of ferromagnetic material common to a plurality of magnetic circuits to extend outside the individual core portions, the winding of the common electromagnet means extending substantially solely inside the elongate portions of ferromagnetic material, seen from the individual core portions.

What is more correctly expressed as distinguishing for a method and printhead in accordance with the invention, and preferred embodiments thereof, is apparent from the independent and subordinate claims.

Arranging electromagnetic means common to a plurality of print elements such as to achieve magnetic field change in accordance with the invention, and coordinated for a plurality of print elements signifies several advantages. Primarily, the forces on all, or a plurality of print elements can be varied in coordination, in appropriate cases, in their movement to the print position in a comparatively simple manner. Only one current needs to be changed, although the printhead may include many print elements. Merely changing one current through a magnetic winding only requires simple and cheap regulating equipment. The forces on the print elments, and thereby their speed of movement, can be infinitely variable within given limits. Further the equipment required in the printhead itself to enable the variations in the forces of the movement mechanism can be relatively restricted, and in the simples case merely consist of a winding common to the print elements. With suitable implementation of the printhead, the electromagnet means common to the print elements can take over the function of the permanent magnets in certain conventional printheads. Since no permanent magnet is required in the printhead, its manufacture can be simplified in certain aspects, inter alia due to the printhead then not attracting magnetic particles.

If individual core portions included in the electromagnet means are arranged in two rows, and ferromagnetic material common to the print element magnetic circuits is arranged so that they extend outside the rows of individual core portions, a particularly advantageous configuration of the printhead can be obtained. The printhead can then be both robust and compact, and the winding of the common electromagnet means can be readily wound so that it extends round all individual core portions and inside the elongate ferromagnetic portions. Further advantages with a method and a printhead in accordance with the invention will be understood by one skilled in the art after studying the description of preferred embodiments.

BEST MODES OF CARRYING OUT THE INVENTION

Figure 1:
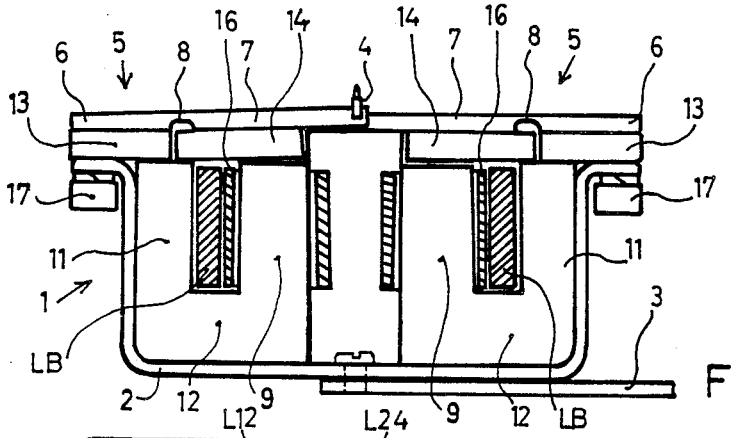
FIG. 1 is a somewhat simplified section through a printhead according to FIG. 2.

A first preferred embodiment of a printhead in accordance with the invention is illustrated in FIGS. 1–4. The printhead 1 has a case 2 attached to a part 3 of an apparatus with which the entire printhead can be moved conventionally relative a record carrier. Apparatus for moving the entire printhead relative a record carrier in connection with printing in different places on the carrier are well known to one skilled in the art and are therefore not described here.

The printhead includes a plurality of print elements 4 and a moving mechanism for moving different, selectable print elements into print and inactive positions. The mechanism includes two carrier members 5. Each carrier member is formed in one piece and as an attachment portion 6, a plurality of element carriers 7 and a plurality of flexing portions 8. Each print element 4 is attached to its own element carrier 7, which is limitedly movable relative the attachment portion 6 and the other element carriers 7 via its own flexing portion 8.

The mechanism further includes two magnetic cores which are substantially alike but one is the opposite hand of the other. Each magnet core includes elongate core portions 11 and 12 and a plurality of individual core portions 9 projecting out from the elongate core portions 12. The core portions 9 are substantially rectangular in cross section and arranged in two parallel rows. The core portions 11 may be said to extend outside and in spaced relationship with the core portions 9 on the sides of the rows of core portions 9 facing away from each other. The core portions 12, which may be said to join or connect the individual core portions 9 with each other and with the core portions 11, may also be said to extend outside or under the core portions 9.

The mechanism also includes a percussion plate 13 and a plurality of movable armatures 14 made from soft magnetic material. The pecussion plate 13 together with the attachment portions 6 of the carrier members is attached to the printhead case 2 with the aid of screws 17. The percussion plate has a plurality of apertures 15 situated approximately at the end of their individual core portions 9. The armatures 14 are each attached to its element carrier 7 and mainly situated in its respective aperture 15 in the percussion plate 13. Each aperture 15 and armature 14 extends (a) over the free end of an individual core portion 9, (b) over a space 16 between this core portion 9 and one of the elongate core portions 11 and (c) over a part of this core portion 11. The printhead is kept together with the aid of screws 17 extending through the case 2, holes 18 in the percussion plate and holes 19 in the support members.

The mechanism includes its own substantially closed magnetic circuit for each of the print elements 4. Each such magnetic circuit includes its own core portion 9 and armature 14. If the carrier member is made from soft magnetic material, the element carrier 7 of a print element may be considered as being included in the magnetic circuit of the print element. The core portions 11 and 12, as well as the percussion plate 13 are also included in the magnetic circuit of each print element. For generating magnetic fields in the magnetic circuits of the print elements, the moving mechanism has a plurality of first individual electromagnet windings L1, L2, . . . L24 and a common second electromagnet winding LB. Together with the magnetic cores the windings form a plurality of fist electromagnet means individual to each print element and a second electromagnet means common to the print elements.

Figure 2:
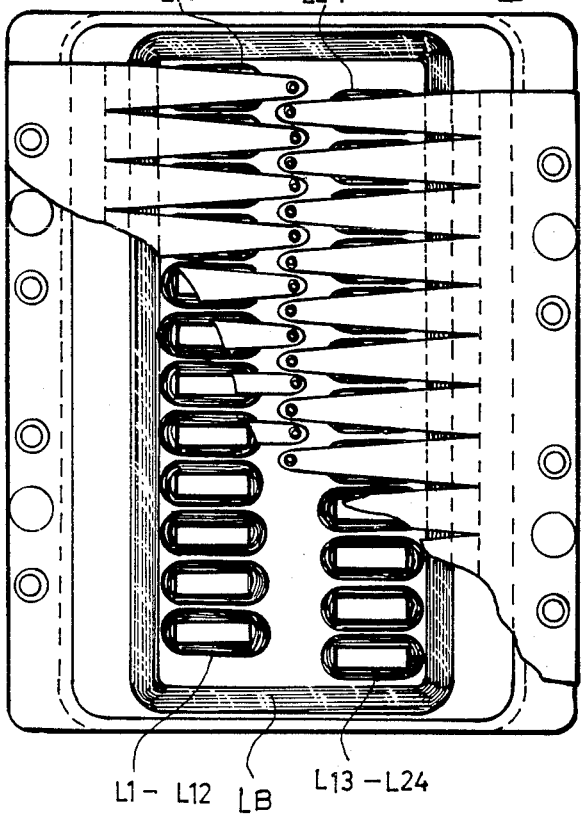
FIG. 2 is a somewhat simplified illustration of a printhead according to FIG. 1 without percussion plate.
Figure 3:
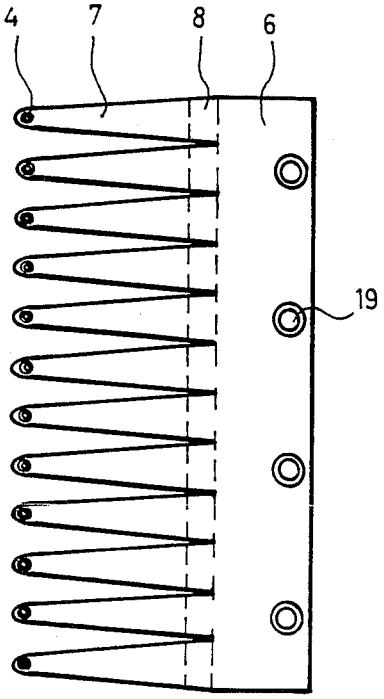
FIG. 3 illustrates a carrier member for the printhead according to FIGS. 1 and 2.
Figure 4:
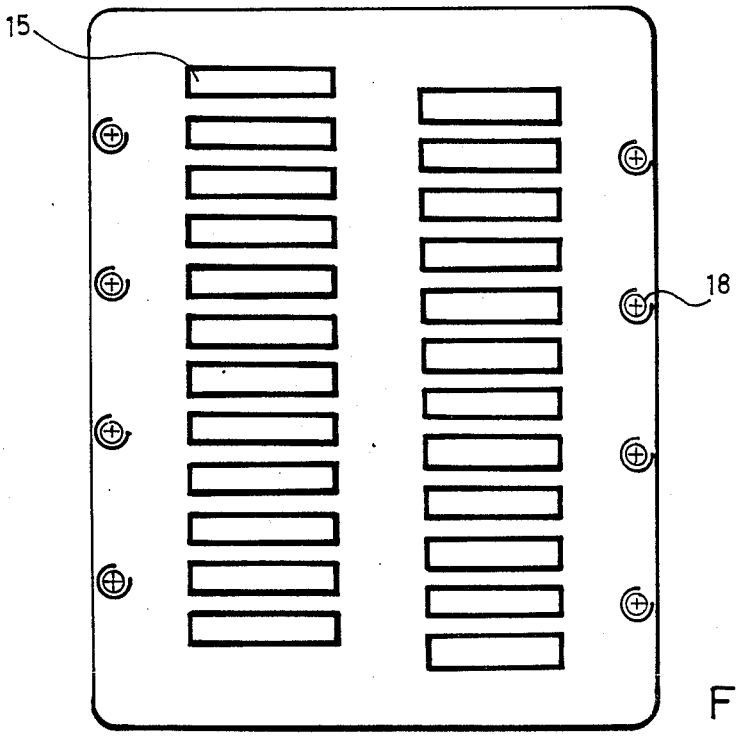
FIG. 4 illustrates a percussion plate for a printhead according to FIGS. 1 and 2.

It will be seen from FIGS. 1 and 2 that the individual electromagnet windings L1-L28 are each wound round an individual core portion 9 of substantially rectangular cross section. In addition, each individual winding, e.g. L1, extends through a space 16 along nearly the whole of an individual core portion from its end at the portion 12 to its free end at the armature 14. By changing a current passing through an individual electromagnet winding, changing the magnetic field in an individual core portion 9 can take place by direct induction. Such directly induced magnetic field changes in individual core portions naturally cause magnetic field changes in remaining parts of the magnetic circuits in a more indirect way, since the magnetic circuits have a substantially closed implementation.

Such magnetic fields and magnetic field changes, which can be induced directly in the individual core portions with the aid of current and current changes in the common electromagnet winding, differ primarily as far as their coverage is concerned, from such magnetic fields and magnetic field changes, which can be directly induced in the individual core portions with the aid of a current or a current change in an individual electromagnet winding. A current or current change in the common winding has substantially the same induction action in all individual core portions. On the other hand, a current or current change in an individual electromagnet winding has a comparatively large induction action in an individual core portion and a comparatively small or entirely insignificant induction action on remaining individual core portions. The induction action from the common and the individual windings can be superposed on individual core portions and remaining parts of the magnetic circuits, e.g. the portions 11 and 12 or the armatures 14. Depending on the size and direction of currents before and after a change, the individual electromagnet windings can co-act with or counter-act the common electromagnet winding in inducing magnetic fields in the magnetic circuits. This is utilised in a method and a printhead in accordance with the invention for changing the forces, from certain values for certain currents to other values for other currents, with which the print elements are in appropriate places moved into print and inactive positions either individually or in selectable combination.

A magnetic field in the magnetic circuit of a print element generates magnetic field-responsive forces on the movable armature 14 in the circuit. Independent of the direction of any current through the electro-magnetic conductors, the magnetic field-responsive forces strive to move the armature 14 in a direction towards the individual core portion in the magnetic circuit. The percussion plate, carrier elements and armatures are formed such that each armature can be moved to an end position close to the free end of the respective core portion, but not into direct contact with the end of this core portion. When the respective armature is at a distance of some hundredths of a millimetre from the free end of the respective core portion, the element carrier to which the armature is attached engages against the percussion plate outside the respective aperture. The element carriers, flexing portions and armatures of the carrier members are further implemented so that the spring bias in each flexing portion 8 strives to take the respective armature to a neutral position substantially further away from the free end of the respective core portion than the end position. Depending on the magnitude of the magnetic field in the magnetic circuit of a print element, the forces acting on the armature and coming from the flexing portion and the magnetic field therefore strive together to move the armature towards the end position or neutral position or a position between the neutral position and end position. Since the respective print element 4 is attached to the same element carrier 7 as the armature 14, the respective print element can thus be moved by variation of a current through the respective electromagnet winding. For example, each print element may have an inactive position determined by the end position of the armature and a print position determined by the neutral position of the armature, or a position more or less differing therefrom due to the record carrier. In FIG. 1, the right hand armature 14 and associated element carrier 7 have been illustrated in their end position while the left hand armature 14 and associated element carrier 7 have been illustrated in a position further away from the end of their electromagnet portion.

Figure 5:
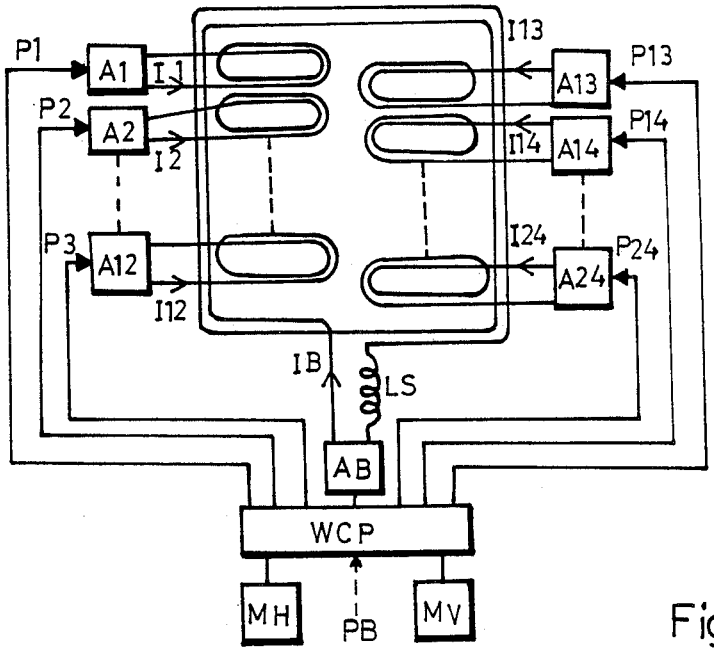
FIG. 5 is a simplified block diagram of control means for currents inwindings in a printhead according to FIGS. 1 and 2.

In FIG. 5, a simplified block diagram illustrates how the forces on the print element can be varied in accordance with the invention. Each individual electromagnet winding L1, L2, . . . L24 is connected to an individual, controllable generator A1, A1, . . . A24 for generating current pulses I1, I2, . . . I24 in the respective winding. Each generator is connected to a print control means WCP for receiving separate control signals P1, P2, . . . P24 with which the generation of current pulses by the respective generator can be controlled from the print control means. The common electromagnet winding LB is also connected to its own controllable generator AB for generating a changeable current through the common electromagnet winding. The controllable generator AB is in turn connected to the print control means WCP for receiving control signals PB, with which the generation of current IB by the generator AB through the common electromagnet winding LB can be varied. There are two drive motors MH and MV with control means connected to the print control means for receiving control signals for moving the position of the printhead in relation to a record carrier. The embodiment of print control means, drive motors and generators for the individual electromagnet windings, and their co-action in conventional printheads is well known to one skilled in the art and is not described here. In operation, the generator AB generates a current IB through the common electromagnet winding LB of a magnitude such that in the absence of current through all individual electromagnet windings L1, L2, . . . L24, the magnetic field-responsive forces in each circuit are sufficient to take each print element from print position to an inactive position, all armatures 14 being close to the end of their respective core portions 9. The current through the electromagnet winding can then be said to keep all the print elements in inactive positions. The common electromagnet winding may be therefore termed a hold winding. When printing is to take place with a selectable print element, e.g. number 7, the corresponding generator A7, is controlled such as to generate a current pulse of a given magnitude and direction through the corresponding individual electromagnet winding L7. The direction of the current pulse is then such that the current in the individual electromagnet winding L7 has an induction action which is counter-directed to the induction action of the current IB through the common electromagnet winding LB. The magnetic field in the magnetic circuit associated with the print element number 7 is thus weakened, whereat the magnetic field-responsive forces striving to pull the corresponding armature 14 towards the corresponding end of its corresponding individual core portion are weakened. The magnitude and shape of the current pulses is such that the magnetic field in the magnetic circuit and the magnetic field-responsive forces will be so weak that the spring bias in the flexing portion 8 of the carrier member can momentarily overcome the magnetic field-responsive forces on the armature 14 and take the armature in a direction away from the end of the individual core portion 9. The corresponding print element thus moves in a direction away from the individual electromagnet cores towards its print position. The individual electromagnet winding can therefore be termed the print winding. The force with which the print element is thus moved to its print position depends on the differences between the spring forces from the carrier member and the magnetic field-responsive forces. Both spring forces and magnetic fields-responsive forces vary with the position of the respective armature. The spring forces in a given position depend on material selection and dimensions, and cannot be simply and rapidly changed without changing the position of the armature. On the other hand, by changing the current IB in the common electromagnet winding, the magnetic field-responsive forces may be changed simply and rapidly in any position of an armature. Here-,it is of course not the change sequence itself which is desirable, but the difference between the magnetic field-responsive forces before current change and these forces after the current change in corresponding positions for respective armatures.

Due to the least almost closed form of the magnetic circuits, a current pulse in an individual electromagnet winding will induce, via a change in a magnetic field, a voltage pulse across the common electromagnet winding. In order that this voltage pulse will not achieve too great an alternation of the current through the common electromagnet winding, an exterior inductance LS in series connected with the common electromagnet winding.

In a method and printhead in accordance with the invention, there are of course natural limitations imposed on the forces with which the print elements can be moved between their print and inactive positions. An upper limit is of course set by the maximum spring forces in the carrier member. Since the magnetic field-responsive forces in a magnetic circuit of the kind in question are of an attracting and not repelling nature, the highest resulting force which can be achieved on an armature in a direction away from the free end of a core portion 9 is the force which can be achieved when the induction action from the common and the individual electromagnet windings completely counteract each other without giving rise to any magnetic attraction forces on the respective armature. Furthermore, to change the forces in the magnetic circuit the current through the common electromagnet winding both before and after possible change must be sufficiently great for the magnetic forces to overcome the spring forces, when no current is generated in the individual electromagnet windings. In addition, the currents through the individual electromagnet windings must be of such a size in appropriate cases that they counteract to a sufficient extent the currents in the common electromagnet winding on the generation of magnetic fields, both before and after possible change of the current through this winding. Finally, there are of course limitations when it is a question of permitted heat generation in the printhead.

It is conceivable to allow possible currents in the individual electromagnet windings to have a direction such that they co-act with, instead of counteracting the current through the common electromagnet winding. In such a case, the currents in the individual electromagnet windings and the common electromagnet windings are selected such that they are sufficiently weak to be individually unable to generate a sufficient magnetic field for taking the respective element carrier and armature to its end position nearest its core portion. The current in the common electromagnet winding is selected such that together with a given current to an optional, individual electromagnet winding it is capable of generating amagnetic field which will take coresponding armature and element carrier to the end position closest to the respective core portion.

An upper limit for the kinetic energy a print element can have when it impinges on a record carrier during printing is set in a corresponding way by the mechanical energy stored in a flexing portion when an armature is taken to its end position closest to the respective core portion.

It is conceivable to implement a printhead in accordance with the invention somewhat differently from what has been illustrated in FIGS. 1-4, even though such implementations would not appear to be preferable for the time being. For example, the movement transmission mechanism could be somewhat differently implemented. It is also conceivable that instead of one common electromagnet winding for all magnetic circuits there are two electromagnet windings, each for its respective row of first individual electromagnetic cores. It is conceivable that the common electromagnet windings could then each be wound around its elongate portion 11 of magnetic material instead of around a row of individual core portions 9. The print elements could be somewhat differently implemented than in FIG. 1, and possibly be arranged along a weakly curving curve instead of along a straight line. The individual core portions can optionally be arranged along one or more weakly curving curves or in two or more groups, instead of along two parallel lines. The number of individual core portions 9 and the number of print elements does not need to be 24, of course, but may be greater or less. For the invention to have great practical value, the number of individual core portions and print elements must not be too small, however. The print position of a print element does not necessarily need to agree with the position where all mechanical forces on the element carrier and armature statically balance each other. It is conceivable that the print position of the print element is closer or farther away from the electromagnetic core. The print position of a print element may also differ from time to time, e.g. depending on what record carrier is used. The printhead parts do not need to be kept together by screws extending through both percussion plate and carrier member, and at least some of the parts of the printhead can be joined together by other known means. Instead of, or as a supplement to the outside inductance LS in series with the common winding LB, the amplifier AB may be given a high output impedance. Further modifications are conceivable within the scope of the claims.

I claim:

1. A method of controlling a plurality of print elements of a printhead each arranged to execute a strinking motion comprising the steps of:

controlling a variable strength resultant magnetic field about each of a plurality of print element actuating means; and controlling a magnetic field opposed to said variable strength resultant magnetic field about an individual one of said print element actuating means, whereby a corresponding individual one of said print elements executes said striking motion with a controlled forcefulness dependent on said variable strength resultant magnetic field.

2. A method as claimed in claim 1 wherein said opposing magnetic field is created by direct induction from a first electric current into a ferromagnetic core portion unique to said individual one of said print elements, and said variable strengh resultant magnetic field is varied by common and direct induction from a second electric current into a plurality of ferromagnetic core portions each one of which is unique to a respective print element.

3. A method as claimed in claim 1 wherein in the absence of said first current said individual one of said print elements remains stationary despite variation of said second current.

4. A printhead comprising:

a plurality of print elements each arranged to execute a striking motion;

a first electromagnet means for controlling a variable strength resultant magnetic field about each of a plurality of print element actuating means, and a plurality of second electromagnet means for controlling magnetic fields opposed to said variable strength resultant magnetic field about individual ones of said print element actuating means, whereby corresponding individual ones of said print elements execute said striking motion with a controlled forcefulness dependent on said variable strength resultant magnetic field.

5. A printhead as claimed in claim 4 wherein at least certain of the second electromagnet means each includes its own second core portion and second electromagnet winding about its core portion, and said first electromagnet means includes a first electromagnet winding extending round the second core portions.

6. A printhead as claimed in claim 4 wherein a moving mechanism includes a magnetic circuit for each print element, said magnetic circuits each including its own second core portion and its own second electromagnet windings about its second core portion, and the first electromagnet means includes a first electromagnet winding extending round the second core portions.

7. A printhead as claimed in claim 4 wherein at least certain of the second electromagnet means each includes its own second core portion and its own second electromagnet winding about its own core portion, said second core portions being substantially arranged in one row, and the first electromagnet means includes a first electromagnet winding extending around one row of second core portions.

8. A printhead as claimed in claim 4 wherein a moving mechanism includes a magnetic circuit for each print element, said magnetic circuits each including its own second core portion and its own second electromagnet winding about its second core portion, said second core portions being substantially situated in one row and the first electromagnet means includes a first electromagnet winding extending round one row of second core portions.

9. A printhead as claimed in claim 5 wherein a first variable current flows in said first electromagnet means and second variable currents flow in said plurality of second electromagnet means, an external inductance being arranged in series with the first electromagnet means to counteract rapid changes in the first current induced by changes in the second currents.

10. A printhead as claimed in claim 4 wherein at least certain of the second electromagnet means each includes its own second core portion and its own second electromagnet winding about its own core portion, said second core portions being substantially arranged in two rows, and the first electromagnet means includes a first electromagnet winding extending around two rows of second core portions.

11. A printhead as claimed in claim 4 wherein a moving mechanism includes a magnetic circuit for each print element, said magnetic circuits each including its own second core portion and its own second electromagnet winding about its second core portion, said second core portions being substantially situated in two rows and the first elctromagnet means includes a second electromagnet winding extending round two rows of said second core portions.

12. A printhead as claimed in claim 11, having elongate portions of ferromagnetic material included in the magnetic circuits, said portions being common to a plurality of magnetic circuits, extending along and outside rows of the second core portions on the sides of the rows thereof facing away from each other, and the first electromagnet winding only extends inside the elongate portions of ferromagnetic material, seen from the second core portions.

13. A method of controlling a plurality of print elements of a printhead each arranged a execute a striking motion comprising the steps of:

passing a variable current through a holding coil in proximity to each of a plurality of print element actuating means, to exert a variable holding force on each of said plurality of print element actuating means; and passing a current through a print coil, arranged to primarily influence an individual one of said print element actuating means, in such a direction as to counteract said variable holding force, whereby a corresponding individual one of said print elements executes a striking motion with a forcefulness depending on said variable current.

14. A method of controlling a plurality of print elements of a printhead each arranged to execute a striking motion, comprising the steps of:

passing a current through a first coil in proximity to each of said plurality of print element actuating means to exert a force on each of said plurality of print element actuating means; and passing a current through a second coil, arranged to primarily influence an individual one of said print element actuating means, in such a direction as to counteract said force, whereby a corresponding individual one of said print elements executes a striking motion with a forcefulness dependent on said current through said first coil.

* * * * *